US006703149B2

(12) United States Patent
Kuno

(10) Patent No.: US 6,703,149 B2
(45) Date of Patent: Mar. 9, 2004

(54) METHOD AND APPARATUS FOR PRODUCING REFORMED HYDROCARBON AND HYDROGEN, ENGINE INSTALLED WITH FUEL CELL, AND ENERGY STATION

(75) Inventor: Masaya Kuno, 1-7-13, Tsuruma, Machida-city, Tokyo 194-0004 (JP)

(73) Assignees: Masaya Kuno (JP); Ohkawara Kakohki Co., Ltd. (JP)

( * ) Notice: Subject to any disclaimer, the term of this patent is extended or adjusted under 35 U.S.C. 154(b) by 110 days.

(21) Appl. No.: 10/022,850

(22) Filed: Dec. 20, 2001

(65) Prior Publication Data

US 2002/0125173 A1 Sep. 12, 2002

(30) Foreign Application Priority Data

Dec. 20, 2000 (JP) ..... 2000-405068

(51) Int. Cl.[7] ..... H01M 8/00; B01J 8/02; C07C 4/02; C07C 5/327

(52) U.S. Cl. ..... 429/12; 422/211; 585/653; 585/654; 208/108

(58) Field of Search ..... 208/108; 585/653, 585/654; 422/211; 429/12, 13, 17, 25, 20

(56) References Cited

U.S. PATENT DOCUMENTS

| | | | | |
|---|---|---|---|---|
| 4,366,047 A | * | 12/1982 | Winter et al. | 208/89 |
| 4,368,113 A | * | 1/1983 | Winter et al. | 208/89 |
| 4,579,838 A | * | 4/1986 | Bearden, Jr. et al. | 502/219 |
| 6,096,191 A | * | 8/2000 | Kalnes | 208/105 |
| 6,402,935 B1 | * | 6/2002 | Kalnes | 208/89 |
| 6,451,197 B1 | * | 9/2002 | Kalnes | 208/58 |

* cited by examiner

*Primary Examiner*—Patrick Ryan
*Assistant Examiner*—Thomas H. Parsons
(74) *Attorney, Agent, or Firm*—Parkhurst & Wendel, L.L.P.

(57) ABSTRACT

A reformed hydrocarbon and hydrogen are produced by: subjecting a raw hydrocarbon material to thermal catalytic cracking under hydrogen for dehydrogenation to produce a reformed hydrocarbon having a degree of unsaturation higher than that of the raw hydrocarbon material and hydrogen; introducing the reformed hydrocarbon, hydrogen and an unreacted hydrocarbon into a pressure-reducing-rising device; and reducing and then raising a pressure to facilitate further cracking of the unreacted hydrocarbon and promote liquid-gas separation in a post-step. Hydrogen can be efficiently produced, and a reformed hydrocarbon of good quality (e.g., high octane number) can be produced with suppressing generation of carbon.

7 Claims, 2 Drawing Sheets

METHOD AND APPARATUS FOR PRODUCING REFORMED HYDROCARBON AND HYDROGEN, ENGINE INSTALLED WITH FUEL CELL, AND ENERGY STATION

BACKGROUND OF THE INVENTION AND RELATED ART STATEMENT

The present invention relates to a method and an apparatus for effectively cracking hydrocarbon and, in particular, to a method and an apparatus for efficiently producing a reformed hydrocarbon having a high octane number and hydrogen from a raw hydrocarbon material such as a saturated hydrocarbon, a fuel cell-mounting engine having further improved energy efficiency with using the method and the apparatus, and an energy station.

In accordance with a worldwide increase of environmental regulation, an engine using a hydrocarbon fuel has been required to save fuel consumption and lower emission of $CO_2$ gas in recent years. A reduction in $CO_2$ gas emission has the same meaning as an improvement in energy efficiency in combustion of hydrocarbon. A fuel cell is used for the above purpose nowadays.

The most efficient fuel for a fuel cell is hydrogen because hydrogen easily reacts on an appropriate surface of a fuel cell at a temperature higher than room temperature to produce electricity.

Since hydrogen is a gas having the smallest molecular weight, it has a problem of how to be produced, transported, and stored for a fuel cell.

Recently, a hybrid engine having a typical reciprocating engine and a secondary battery combined therewith has been put to a practical use. However, even the hybrid engine has an energy efficiency of at most 30%.

Therefore, the present invention has been made in view of the aforementioned conventional problem and aims to provide a method and an apparatus capable of efficiently producing hydrogen and producing a reformed hydrocarbon of good quality (high octane number, etc.) with suppressing carbon formation, a fuel cell-mounting engine having further improved energy efficiency with using the method and apparatus, and an energy station.

SUMMARY OF THE INVENTION

According to the present invention, there is provided a method for producing a reformed hydrocarbon and hydrogen, comprising the steps of:

subjecting a raw hydrocarbon material to thermal catalytic cracking under hydrogen for dehydrogenation to produce a reformed hydrocarbon having a degree of unsaturation higher than that of the raw hydrocarbon material and hydrogen, introducing the reformed hydrocarbon, hydrogen and an unreacted hydrocarbon into a pressure-reducing-rising device, and reducing and then raising a pressure to facilitate further cracking of the unreacted hydrocarbon and promote liquid-gas separation in a post-step.

According to the present invention, there is further provided an apparatus for producing a reformed hydrocarbon and hydrogen, comprising:

a reactor in which a raw hydrocarbon material is subjected to thermal catalytic cracking under hydrogen for dehydrogenation to produce a reformed hydrocarbon having a degree of unsaturation higher than that of the raw hydrocarbon material and hydrogen, a pressure-reducing-rising device for subjecting the reformed hydrocarbon, hydrogen and unreacted hydrocarbon obtained in the reactor to pressure reduction and pressure rising, and a separator for separating the reformed hydrocarbon, hydrogen and unreacted hydrocarbon obtained in the pressure-reducing-rising device into gas components composing hydrogen and liquid components composing a reformed hydrocarbon and the unreacted hydrocarbon by a liquid-gas separation operation.

According to the present invention, there is still further provided a fuel cell-mounting engine comprising:

a reactor in which a raw hydrocarbon material is subjected to thermal catalytic cracking under hydrogen for dehydrogenation to produce a reformed hydrocarbon having a degree of unsaturation higher than that of the raw hydrocarbon material and hydrogen, a pressure-reducing-rising device for subjecting the reformed hydrocarbon, hydrogen and unreacted hydrocarbon obtained in the reactor to pressure reduction and pressure rising, a separator for separating the reformed hydrocarbon, hydrogen, and unreacted hydrocarbon obtained in the pressure-reducing-rising device into gas components composing hydrogen, and liquid components composing a reformed hydrocarbon and the unreacted hydrocarbon by a liquid-gas separation operation, a fuel cell using, as a fuel, the gas components composing hydrogen obtained from the separator, and an engine using, as a fuel, the reformed hydrocarbon obtained from the separator.

According to the present invention, there is yet further provided an energy station comprising:

a reactor in which a raw hydrocarbon material is subjected to thermal catalytic cracking under hydrogen for dehydrogenation to produce a reformed hydrocarbon having a degree of unsaturation higher than that of the raw hydrocarbon material and hydrogen, a pressure-reducing-rising device for subjecting the reformed hydrocarbon, hydrogen and unreacted hydrocarbon obtained in the reactor to pressure reduction and pressure rising, a separator for separating the reformed hydrocarbon, hydrogen and unreacted hydrocarbon obtained in the pressure-reducing-rising device into gas components composing hydrogen and liquid components composing a reformed hydrocarbon and the unreacted hydrocarbon by a liquid-gas separation operation, and a power unit for operating the pressure-reducing-rising device;

wherein the reformed hydrocarbon and the hydrogen are produced as fuels, and electric energy and thermal energy produced by the operation of the power unit are taken out with the pressure-reducing-rising device being operated by the power unit.

In the present invention, it is preferable to use a reciprocating type of a pressure-reducing-rising device.

In addition, an energy station of the present invention may further comprise a fuel cell using, as a fuel, gas components composing hydrogen obtained from the separator to take out electric energy produced by the fuel cell.

DETAILED DESCRIPTION OF THE INVENTION

Figure 1:
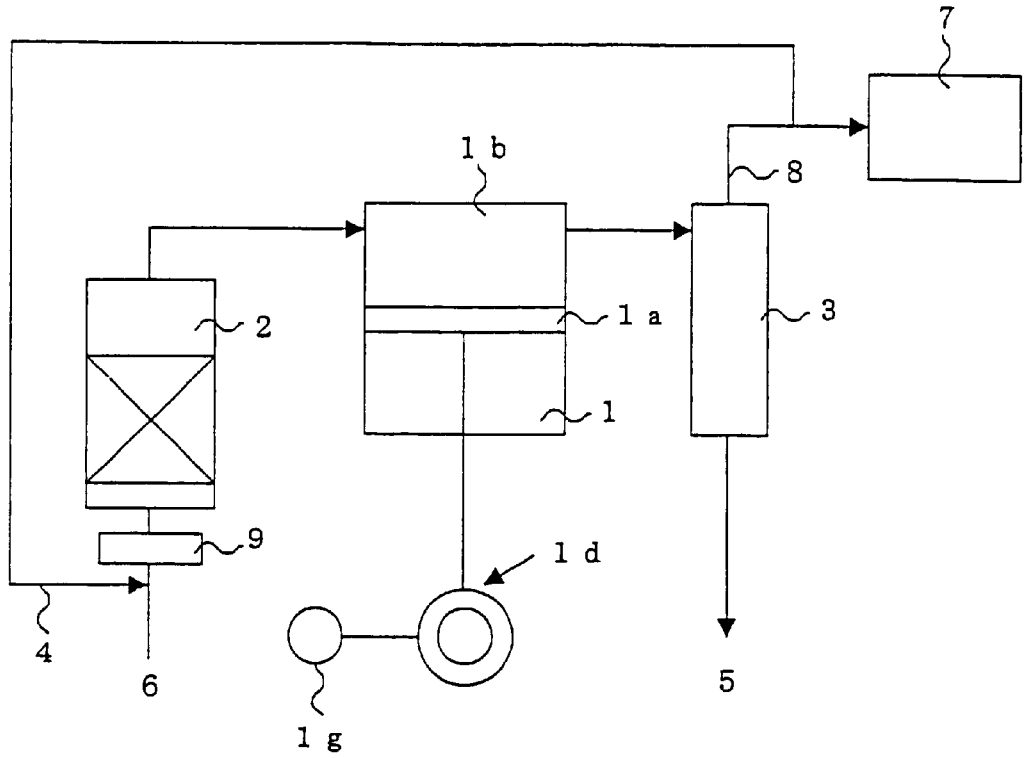
FIG. 1 is a block diagram showing a schematic configuration of an apparatus for producing a reformed hydrocarbon and hydrogen of the present-invention.

The present invention is hereinbelow described in more detail on the basis of embodiments. However, the present invention is by no means limited to these embodiments.

As the basic concept of the present invention, a raw hydrocarbon material (fuel) is subjected to thermal catalytic cracking under hydrogen for dehydrogenation using a reactor filled with catalyst and the like to produce cracked products including a reformed hydrocarbon having an increased degree of unsaturation such as an unsaturated hydrocarbon and hydrogen and to more effectively take out fuel of good quality and hydrogen by a dual effect, by a pressure-reducing-rising function of a reciprocating engine or the like, i.e., by hydrocracking with an activated catalyst and quick thermal cracking under hydrogen.

For example, if a light saturated hydrocarbon is desulfurized and, after raising pressure and temperature, subjected to thermal catalytic cracking in a reactor containing a zeolite catalyst; hydrogen can be produced by dehydrogenation. It is possible to feed the obtained hydrogen to a fuel cell. However, if thermally cracked components (including unreacted components) containing hydrogen obtained in the thermal cracking are fed to a reciprocating engine type cylinder device (pressure-reducing-rising device), further cracking of components in the course of cracking is facilitated due to pressure reduction. Then, by raising the pressure, temperature of the components further rises, which enables further cracking and improves efficiency of gas circulation and liquid-gas separation in a post-step, and as a result, unsaturated hydrocarbon fuel of better quality and hydrogen can be effectively taken out.

Incidentally, the reciprocating engine type cylinder device is preferably provided with an electric discharge mechanism therein because dehydrogenating reaction is promoted further due to radicalization of hydrocarbon by spark discharge of electricity in a plug in the electric discharge mechanism. Though electric discharge may be conducted at the time of pressure reduction or pressure rising, it is more preferably conducted at the time of pressure rising.

Therefore, according to the present invention, a fuel usable in place of gasoline or for diesel can be produced. In the present invention, hydrogen is fed to a fuel cell to generate electricity usable for an electric controller for a motor, an air-conditioner, etc., and hydrocarbon having high octane number (unsatrated) obtained besides can be used as a fuel for the aforementioned reciprocating engine, a rotary engine, a diesel engine, a turbine jet engine, etc., and for a fuel cell-mounting engine suitably.

In addition, the present invention gives various kinds of advantages due to circulated usage of hydrogen. Hydrogen can serve as a heat carrier, avoid carbon formation upon thermal catalytic cracking of a raw hydrocarbon material, and facilitate thermal cracking reaction. A ratio of hydrogen introduced to the reactor to a raw hydrocarbon material such as saturated hydrocarbon (hydrogen/hydrocarbon material) is generally 3–20 (molar ratio), and more preferably 5–10.

What is called a fuel-conversion type engine of the present invention becomes very efficient, particularly by being combined with a fuel cell. As a further development, if, for example, propane or cyclobenzene is thermally cracked in a suitable manner, hydrogen and benzene are obtained, which leads to an engine using completely recycled hydrogen by using only the hydrogen for a fuel cell and the benzene for a petrochemical plant or an oil-refining plant. The one requiring neither a pipeline for hydrogen nor an infrastructure becomes a hydrogen fuel cell type automobile. In this case, two kinds can be considered: One is of an alloy adsorbing and storing hydrogen type, which is cracked and supplied at gas stations; and the other is of a type having cracking in the automobile with returning benzene.

In addition, in the present invention, an energy station is provided with an apparatus for producing a reformed hydrocarbon having an increased degree of unsaturation (e.g., high octane number) and hydrogen, and a power unit for operating the pressure-reducing-rising device. In the energy station, an unsaturated hydrocarbon (reformed hydrocarbon) having a high octane number and hydrogen are taken out as fuels, and the pressure-reducing-rising device is operated by the power unit. Electric energy and thermal energy generated by the operation can be taken out. Such an energy station is preferably provided with a fuel cell further to be effectively used as a station (stand) for supplying a fuel or electric energy to an electric automobile, a hybrid automobile, etc., as well as a reciprocating engine type automobile, which is of the main current at present.

The principle of the present invention is hereinbelow described.

In the case of using heptane ($C_7H_{16}$), which is a saturated hydrocarbon, as a raw hydrocarbon material; if heptane is thermally cracked under hydrogen in a reactor filled with a catalyst and the like, toluene ($C_7H_8$), which is an unsaturated hydrocarbon, and hydrogen are produced (Sekiyugakkai-shi, vol. 9, No. 1, "Successive Operation of Dehydrocyclization-Hydrogenolysis for n-Heptane" (pp. 26–27) (1966).

$$C_7H_{16} \rightarrow C_7H_8 + 4H_2 + \Delta H_1 \quad (1)$$

The reaction shown by the above equation (1) is endothermic.

On the other hand, hydrogen produced by the thermal cracking of heptane ($C_7H_{16}$) can be used as a fuel for a fuel cell, and toluene ($C_7H_8$) can be used as a general fuel for a reciprocating engine. This is shown by the following equation:

$$4H_2 + 2O_2 \rightarrow 4H_2O + \Delta H_2 \quad (2)$$

$$C_7H_8 + 9O_2 \rightarrow 7CO_2 + 4H_2O + \Delta H_3 \quad (3)$$

Each of the reactions shown by the equation (2) and (3) is exothermic, and a heating value of each reaction is much larger in comparison with the endothermic value in the reaction shown by the equation (1); and thereby heat recovery can be easily conducted.

In standard conditions (25° C.), the endothermic value $\Delta H_1$=63 kJ/mole the heating value $\Delta H_2$=242×4=968 kJ/mole, and $\Delta H_3$=3948 kJ/mole.

In addition, the heating value of heptane ($C_7H_{16}$) is 4853 kJ/mole.

A typical engine has an efficiency of about 15% during running. The effective energy of $C_7H_{16}$ is 4853×0.15=728 kJ/mole. On the other hand, since toluene ($C_7H_8$) needs endothermic value of 63 kJ/mole, the fuel is considered to correspond to 3948–63=3885 kJ/mole. If toluene ($C_7H_8$) is used for an engine in a similar manner, the value becomes 3885×0.15=583 kJ/mole supposing that the thermal efficiency is the same. If hydrogen is used for a fuel cell, supposing that the efficiency of the fuel cell is 60%, it becomes 968×0.6=581 kJ/mole; and even if about 70 kJ/mole is needed for circulation energy or so, it becomes 581−70=511 kJ/mole.

Therefore, in a method, an apparatus and an engine of the present invention, energy of (583+511)−728=366 kJ/mole can be effectively used in comparison with a conventional engine. As to the fuel efficiency, it is increased by (366/728)×100=about 50%.

The present invention is hereinbelow described in more detail on the basis of examples shown in the drawings.

EXAMPLE 1

FIG. 1 is a block diagram showing a schematic configuration of an apparatus for producing a reformed hydrocarbon and hydrogen of the present invention.

In the production apparatus, a thermal cracking reactor 2 filled with a zeolite catalyst, a reciprocating engine type cylinder device 1, a liquid-gas separator 3, and a fuel cell 7 are disposed in this order from the upstream side of a raw hydrocarbon material 6 such as a saturated hydrocarbon. When the raw hydrocarbon material 6 and recycled hydrogen 4 coming from the separator 3 are pre-heated by a heater 9 and introduced into the thermal cracking reactor 2, the hydrocarbon material is thermally cracked and dehydrogenated, and a reformed hydrocargon having an increased degree of unsaturation and hydrogen are produced. These cracked products are introduced into the reciprocating engine type cylinder device 1. In the cylinder device 1, a piston-crank mechanism 1*d* is driven to move a piston 1*a* downward; and thereby pressure in a device 1*b* is reduced to promote cracking of unreacted hydrocarbon in the cracked products. Then, a piston-crank mechanism 1*d* is driven to move a piston 1*a* upward; and thereby pressure in a device 1*b* is raised, so that temperature of the unreacted hydrocarbon rises further, enabling further cracking.

The reformed hydrocarbon, hydrogen, and the unreacted hydrocarbon obtained in the cylinder device 1 are then subjected to liquid-gas separation in the separator 3 to be separated into gas components 8 composing hydrogen and liquid components 5 composing a large quantity of reformed hydrocarbon and a small quantity of unreacted hydrocarbon.

Since a reformed hydrocarbon, for example, an unsaturated hydrocarbon predominates in the obtained liquid components 5, the liquid components 5 can be used as a fuel having a high octane value for a typical engine. On the other hand, a part of hydrogen 8 is recycled to the reactor 2, and the rest is used as a fuel for the fuel cell 7.

EXAMPLE 2

Figure 2:
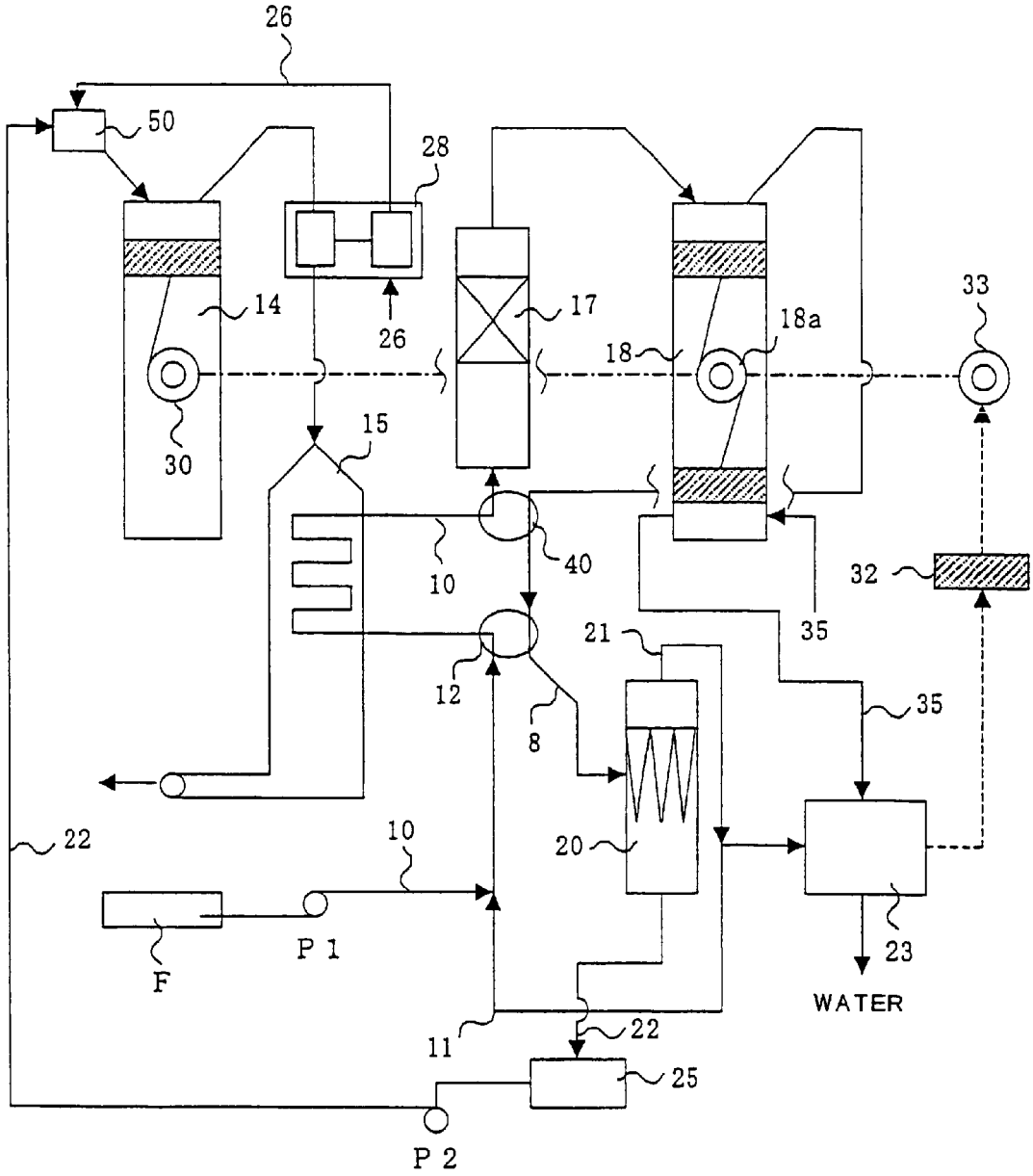
FIG. 2 is a block diagram showing a schematic example of a constitution of a fuel cell-mounting engine of the present invention.

FIG. 2 is a block diagram showing a schematic example of a constitution of a fuel cell-mounting engine of the present invention.

The fuel 10, whose pressure is raised to 5 kg/cm$^2$G by a fuel supply pump P1 from a fuel tank F for storing a hydrocarbon fuel abundantly containing a saturated hydrocarbon such as a chain hydrocarbon, is mixed with the recycled hydrogen 11 at the molar ratio of 5. A temperature of the fuel 10 is raised though a heat exchanger 12 and further raised to 450° C. by a heat exchanger 15 due to an engine exhaust gas emitted from an engine 14. The fuel 10 having a raised temperature in such a manner is introduced to a reactor 17 filled with a desulfurized catalyst or a zeolite catalyst to be cyclodehydrogenated by thermal catalytic cracking, and then introduced into a reciprocating engine type cylinder device 18.

In the reciprocating engine type cylinder device 18, an unreacted hydrocarbon is further cracked and pressurized up to 7 kg/cm$^2$G. The obtained cracked products are cooled through heat exchangers 40 and 12 and introduced into a separator 20 for liquid-gas separation to give a hydrogen-rich gas 21 and a reformed bottom oil (cyclic hydrocarbon) 22. A part of the hydrogen-rich gas 21 is used for a fuel cell 23, and the rest is used as a recycled hydrogen 11.

The reformed bottom oil (unsaturated hydrocarbon) 22 is stored in a reformed bottom oil tank 25 and, by a reformed oil pump P2, mixed, in a mixing chamber 50, with air 26 from outside of the system with temperature of the air 26 being raised by a turbocharger 28, and then introduced into an engine 14 and combusted to produce a rotational energy. The axis of rotation 30 is connected with a motor 33 rotating by electricity passed through a battery 32 storing electricity produced from a fuel cell 23 by means of a crutch, a belt, etc.

The axis of rotation 18*a* in the reciprocating engine type cylinder device 18 is connected with the axis of rotation 30. On the other hand, air 35 for a fuel cell is also heated and purified in the reciprocating engine type cylinder device 18 connected with the axis of rotation 30 and sent to a fuel cell 23.

A raw hydrocarbon material such as a saturated hydrocarbon is converted into a reformed hydrocarbon having an increased degree of unsaturation (e.g., cyclic hydrocarbon) and hydrogen. The former obtains an increased octane value and can produce rotatory power in a reciprocating engine, and the latter can produce rotatory power by a motor of a fuel cell. During traveling, an improvement of efficiency by approximately 75% could be achieved in comparison with a conventional hybrid engine.

As described above, according to the present invention, there can be provided a method and an apparatus capable of efficiently generating hydrogen and producing a reformed hydrocarbon of good quality (e.g., high octane number) with suppressing carbon formation, a fuel cell-mounting engine having further improved energy efficiency with using the method and apparatus, and an energy station.

What is claimed is:

1. A method for producing a reformed hydrocarbon and hydrogen, comprising the steps of:

subjecting a raw hydrocarbon material to thermal catalytic cracking under hydrogen for dehydrogenation to produce a reformed hydrocarbon having a degree of unsaturation higher than that of the raw hydrocarbon material and hydrogen, introducing the reformed hydrocarbon, hydrogen and an unreacted hydrocarbon into a pressure-reducing-rising device, and reducing and then raising a pressure to facilitate further cracking of the unreacted hydrocarbon and promote liquid-gas separation in a post-step.

2. A method for producing a reformed hydrocarbon and hydrogen according to claim 1, wherein the pressure-reducing-rising device is of reciprocating type.

3. An apparatus for producing a reformed hydrocarbon and hydrogen, comprising:

a reactor in which a raw hydrocarbon material is subjected to thermal catalytic cracking under hydrogen for dehydrogenation to produce a reformed hydrocarbon having a degree of unsaturation higher than that of the raw hydrocarbon material and hydrogen, a pressure-reducing-rising device for subjecting the reformed hydrocarbon, hydrogen and unreacted hydrocarbon obtained in the reactor to pressure reduction and pressure rising, and a separator for separating the reformed hydrocarbon, hydrogen and unreacted hydrocarbon obtained in the pressure reducing-rising device into gas components composing hydrogen and liquid components composing a reformed hydrocarbon and the unreacted hydrocarbon by a liquid-gas separation operation.

4. An apparatus for producing a reformed hydrocarbon and hydrogen according to claim 3, wherein the pressure-reducing-rising device is of reciprocating type.

5. A fuel cell-mounting engine comprising:

a reactor in which a raw hydrocarbon material is subjected to thermal catalytic cracking under hydrogen for dehydrogenation to produce a reformed hydrocarbon having a degree of unsaturation higher than that of the raw hydrocarbon material and hydrogen, a pressure-reducing-rising device for subjecting the reformed hydrocarbon, hydrogen and unreacted hydrocarbon obtained in the reactor to pressure reduction and pressure rising, a separator for separating the reformed hydrocarbon, hydrogen and unreacted hydrocarbon obtained in the pressure-reducing-rising device into gas components composing hydrogen and liquid components composing a reformed hydrocarbon and the unreacted hydrocarbon by a liquid-gas separation operation, a fuel cell using, as a fuel, the gas components comprising hydrogen obtained from the separator, and an engine using, as a fuel, the reformed hydrocarbon obtained from the separator.

6. An energy station comprising:

a reactor in which a raw hydrocarbon material is subjected to thermal catalytic cracking under hydrogen for dehydrogenation to produce a reformed hydrocarbon and hydrogen having a degree of unsaturation higher than that of the raw hydrocarbon material, a pressure reducing-rising device for subjecting the reformed hydrocarbon and hydrogen and unreacted hydrocarbon obtained in the reactor to pressure reduction and pressure rising, a separator for separating the reformed hydrocarbon, hydrogen, and unreacted hydrocarbon obtained in the pressure reducing-rising device into gas components composing hydrogen and liquid components composing a reformed hydrocarbon and the unreacted hydrocarbon by a liquid-gas separation operation, and a power unit for operating the pressure-reducing-rising device;

wherein the reformed hydrocarbon and hydrogen are taken out as fuels, and electric energy and thermal energy produced by the operation of the power unit are taken out with the pressure-reducing-rising device being operated by the power unit.

7. An energy station according to claim 6, further comprising a fuel cell using, as a fuel, the gas components composing hydrogen obtained from the separator to take out electric energy produced by the fuel cell.

* * * * *